United States Patent [19]

Saad et al.

[11] Patent Number: 4,604,627

[45] Date of Patent: Aug. 5, 1986

[54] FLARED MICROWAVE FEED HORNS AND WAVEGUIDE TRANSITIONS

[75] Inventors: Saad S. Saad, Willowbrook; Charles M. Knop, Lockport, both of Ill.

[73] Assignee: Andrew Corporation, Orland Park, Ill.

[21] Appl. No.: 569,789

[22] Filed: Jan. 11, 1984

[51] Int. Cl.[4] ..... H01Q 13/02

[52] U.S. Cl. ..... 343/786; 343/840

[58] Field of Search ..... 343/786, 840, 912

[56] References Cited

U.S. PATENT DOCUMENTS 3,662,393 5/1972 Cohn ..... 343/786

4,442,437 4/1984 Chu et al. ..... 343/786

*Primary Examiner*—Eli Lieberman

*Attorney, Agent, or Firm*—Leydig, Voit & Mayer, Ltd.

[57] ABSTRACT

A horn-reflector antenna comprising a paraboloidal reflector for transmitting and receiving microwave energy, and a flared feed horn for guiding microwave energy to and from the reflector, the longitudinal shape of at least a section of the horn at the end where the horn begins to flare outwardly being defined by the equation $$R^p = R_1^p + \left( \frac{R_2^p - R_1^p}{L^p} \right) l^p$$

where R is the transverse dimension from the longitudinal axis of the horn to the side wall of the horn 1 is the axial distance along the horn measured from the end where the horn begins to flare outwardly, $R_1$ and $R_2$ are the radii of the horn at opposite ends of the horn section defined by the equation, L is the axial length of the horn section defined by the equation, and the exponent p has a value greater than two and less than about 7, to effect a substantial reduction in the $TM_{11}$ mode level.

12 Claims, 9 Drawing Figures

FLARED MICROWAVE FEED HORNS AND WAVEGUIDE TRANSITIONS

TECHNICAL FIELD

The present invention relates generally to microwave antennas and waveguides. In its principal applications, this invention relates to reflector-type antennas fed with a flared horn, such as horn-reflector antennas, and to waveguide transitions for joining waveguides of different sizes and/or shapes.

BACKGROUND ART

One of the problems encountered in current horn-reflector antennas is the $TM_{11}$-mode "echo" signal generated in the input section of the horn due to the incident $TE_{11}$ mode there. Thus, in the transmitting case, this undesired $TM_{11}$ mode travels down through the waveguide feeding the horn until it encounters a waveguide transition at the lower end of that waveguide, and is then reflected back up through the waveguide feed and reconverted to the desired $TE_{11}$ mode in the input section of the horn. This produces two transmitted $TE_{11}$ mode signals which are not in phase with each other, thereby degrading the RPE (Radiation Pattern Envelope) and giving rise to a group delay problem which results in undesired "crosstalk" in the microwave signals.

DISCLOSURE OF THE INVENTION

It is a primary object of the present invention to provide a reflector-type microwave antenna having an improved feed horn which produces low levels of undesired, higher order modes such as the $TM_{11}$ mode, thereby improving the RPE of the antenna and minimizing group delay (and its resultant "crosstalk"). In this connection, a related object of the invention is to provide such an improved feed horn which upgrades the overall performance of the antenna.

It is another important object of this invention to provide such an improved antenna which minimizes return loss in both the transmit and receive directions.

A further object of this invention is to provide an improved horn-reflector antenna which is capable of producing improved results of the type described above over a relatively wide frequency band, e.g., as wide as 20 GHz.

Still another object of this invention is to provide improved overmoded waveguide transitions which produce low levels of undesired, higher order modes such as the $TM_{11}$ mode, in combination with a low return loss in both directions. A related object is to provide such overmoded waveguide transitions which offer the improved performance over a relatively wide frequency band.

Other objects and advantages of the invention will be apparent from the following detailed description and the accompanying drawings.

In accordance with one aspect of the present invention, certain of the foregoing objects are realized by a horn-reflector antenna comprising a paraboloidal reflector for transmitting and receiving microwave energy; and a feed horn for guiding microwave energy to and from the reflector, the longitudinal shape of a section of the horn at the smaller end thereof being defined by the equation:

$$r/a^p - l/b^p = 1 \qquad (1)$$

where a and b are constants, r is the radius of the horn, l is the axial distance along the horn, and the exponent p has a value greater than two.

In accordance with another aspect of the present invention, certain of the foregoing objects are realized by an overmoded waveguide transition comprising a flared waveguide section having different predetermined transverse cross sections at opposite ends thereof, the longitudinal shape of a section of the transition adjacent at least one end thereof being defined by Equation (1) above, where a and b are constants, r is the radius of the transition, l is the axial distance along the transition measured from said one end thereof, and the exponent p has a value greater than two.

While the invention will be described in connection with certain preferred embodiments, it will be understood that it is not intended to limit the invention to those particular embodiments. On the contrary, it is intended to cover all alternatives, modifications and equivalent arrangements as may be included within the spirit and scope of the invention as defined by the appended claims.

BEST MODES FOR CARRYING OUT THE INVENTION

Figure 1:
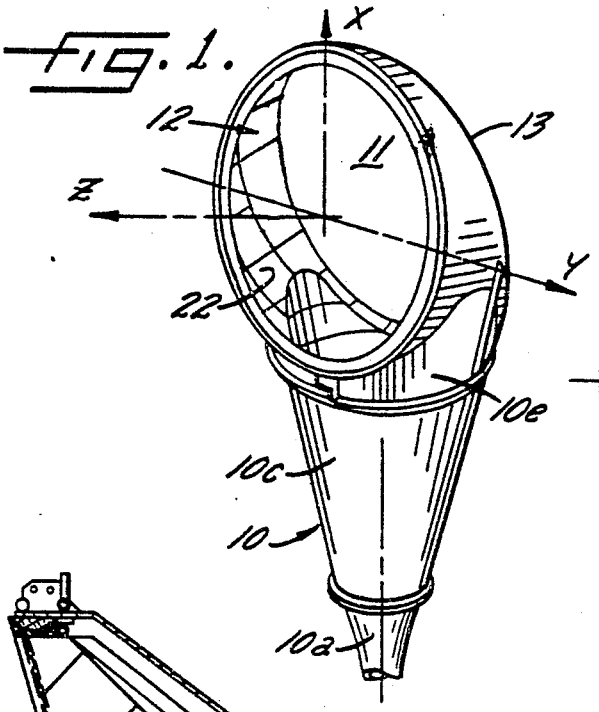
FIG. 1 is a perspective view of a horn-reflector antenna embodying the present invention.
Figure 2:
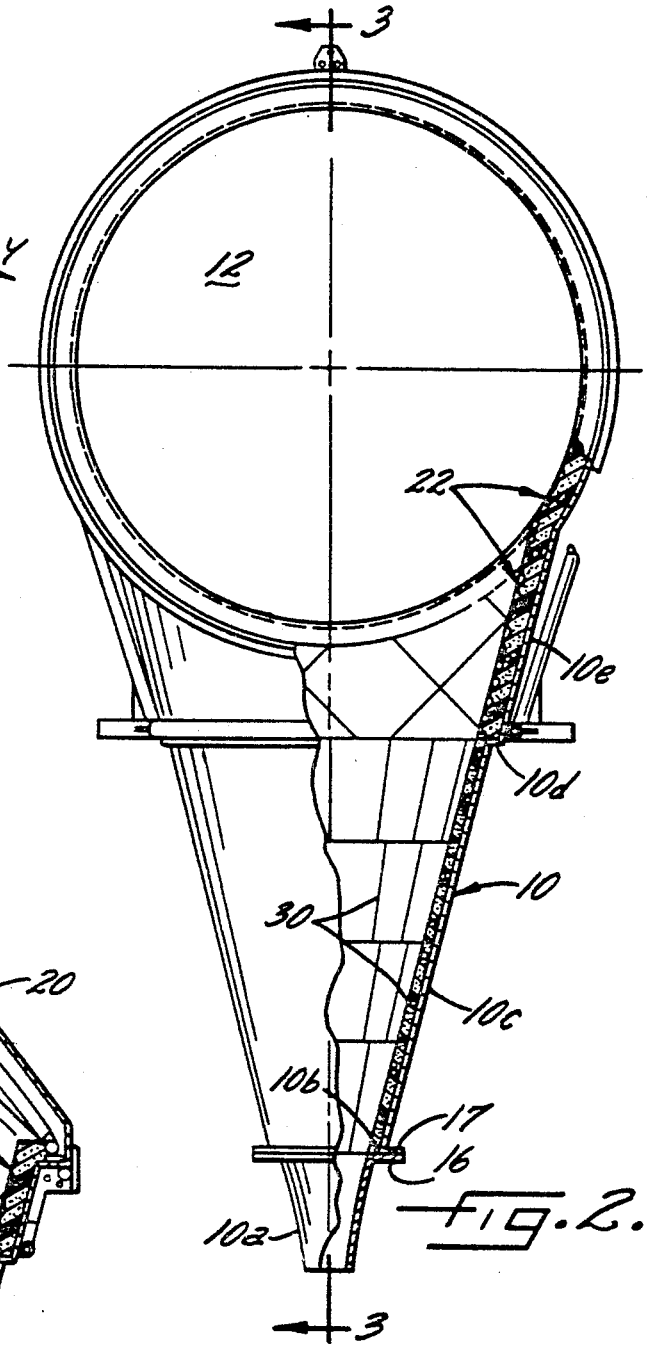
FIG. 2 is a front elevation, partially in section, of the antenna illustrated in FIG. 1.
Figure 3:
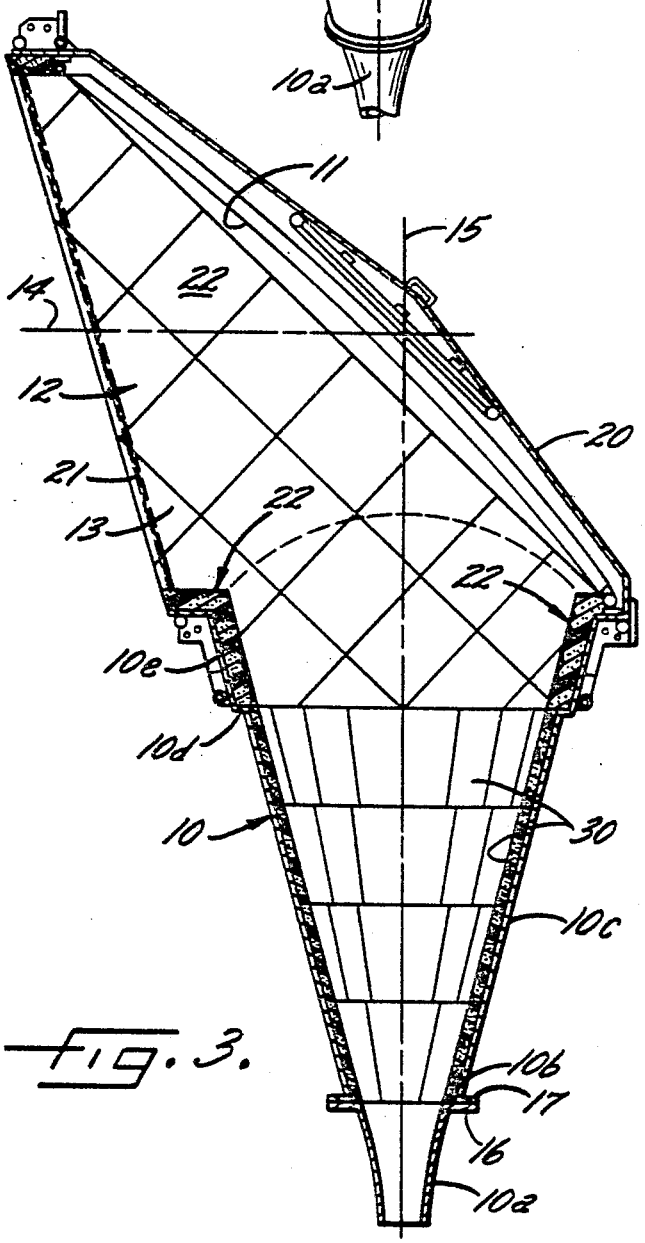
FIG. 3 is a section taken generally along line 3—3 in FIG. 2.
Figure 4:
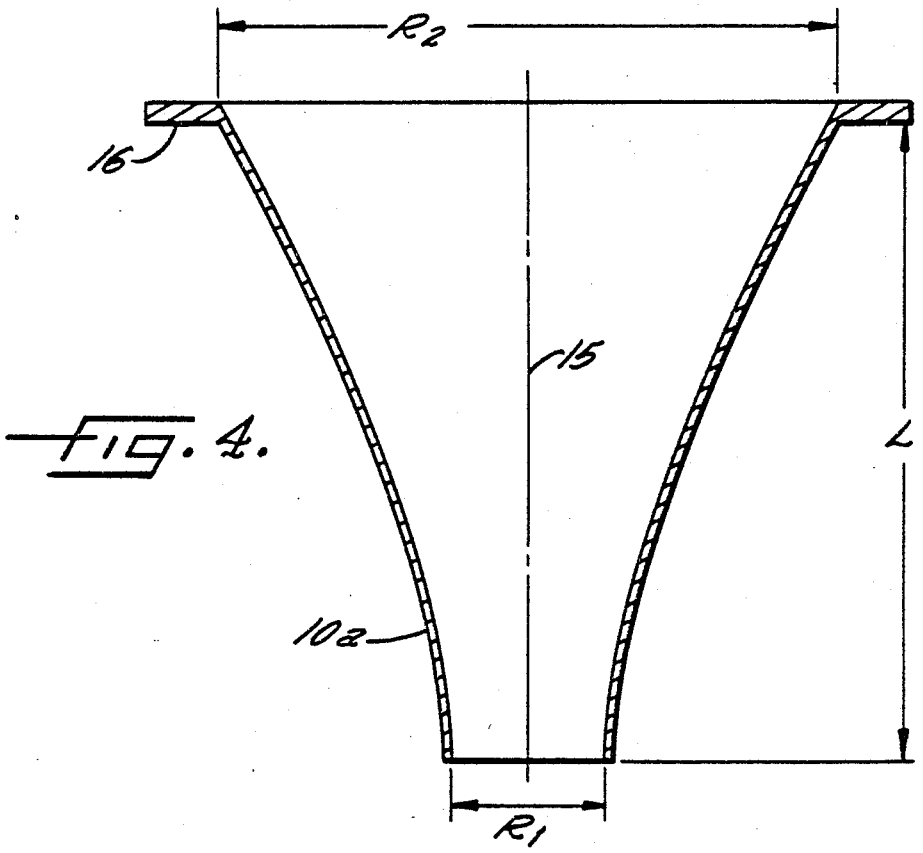
FIG. 4 is an enlarged view of the lower end portion of the conical section of the antenna of FIGS. 1–3.

Turning now to the drawings and referring first to FIGS. 1 through 3, there is illustrated a horn-reflector microwave antenna having a flared horn 10 for guiding microwave signals to a parabolic reflector plate 11. From the reflector plate 11, the microwave signals are transmitted through an aperture 12 formed in the front of a cylindrical shield 13 which is attached to both the horn 10 and the reflector plate 11 to form a completely enclosed integral antenna structure.

The parabolic reflector plate 11 is a section of a paraboloid representing a surface of revolution formed by rotating a parabolic curve about an axis which extends through the vertex and focus of the parabolic curve. As is well known, any microwaves originating at the focus of such a parabolic surface will be reflected by the plate 11 in planar wavefronts perpendicular to an axis 14, i.e., in the direction indicated by the Z axis in FIG. 1. Thus, the horn 10 of the illustrative antenna is arranged so that its apex coincides with the focus of the paraboloid, and so that the axis 15 of the horn is perpendicular to the axis of the paraboloid.

With this geometry, a diverging spherical wave emanating from the horn 10 and striking the reflector plate 11 is reflected as a plane wave which passes through the aperture 12 with a wavefront that is perpendicular to the axis 14. The cylindrical shield 13 serves to prevent the reflector plate 11 from producing interfering side and back signals and also helps to capture some spillover energy launched from the feed horn 10. It will be appreciated that the horn 10, the reflector plate 11, and the cylindrical shield 13 are usually formed of conductive metal (though it is only essential that the reflector plate 11 have a metallic surface).

To protect the interior of the antenna from both the weather and stray signals, the top of the reflector plate 11 is covered by a panel 20 attached to the cylindrical shield 13. A radome 21 also covers the aperture 12 at the front of the antenna to provide further protection from the weather. The inside surface of the cylindrical shield 13 is covered with an absorber material 22 to absorb stray signals so they do not degrade the RPE. Such absorber materials are well known in the art, and typically comprise a conductive material such as metal or carbon dispersed throughout a dielectric material having a surface in the form of multiple pyramids or convoluted cones.

In the illustrative embodiment of FIGS. 1–3, the bottom section **10*a* of the conical feed horn 10 has a smooth inside metal surface, and the balance of the inside surface of the conical horn 10 is formed by an absorber material 30. The innermost surfaces of the metal section 10*a* and the absorber material 30 define a single continuous conical surface. To support the absorber material 30 in the desired position and shape, the metal wall of the horn forms an outwardly extending shoulder 10*b* at the top of the section 10*a*, and then extends upwardly along the outside surface of the absorber 30. This forms a conical metal shell 10*c* along the entire length of the absorber material 30. At the top of the absorber material 30, the metal wall forms a second outwardly extending shoulder 10*d* to accommodate a greater thickness of the absorber material 22 which lines the shield portion of the antenna above the conical feed horn. If desired, one or both of the shoulders 10*b* and 10*d* can be eliminated so as to form a smooth continuous metal surface on the inside of the horn 10; if the absorber lining 30** is used in this modified design, it extends inwardly from the continuous metal wall.

The lining 30 may be formed from conventional absorber materials, one example of which is AAP-ML-73 absorber made by Advanced Absorber Products Inc., 4 Poplar Street, Amesbury, Maine. This absorber material has a flat surface (in contrast to the pyramidal or conical surface of the absorber used in the shield 13) and is about ⅜ inch thick. The absorber material may be secured to the metal walls of the horn 10 by means of an adhesive. When the exemplary absorber material identified above is employed, it is preferably cut into a multiplicity of relatively small pads which can be butted against each other to form a continuous layer of absorber material over the curvilinear surface to which it is applied. This multiplicity of pads is illustrated by the grid patterns shown in FIGS. 1–3.

In accordance with an important aspect of the present invention, the longitudinal shape of a section of the feed horn 10 at the smaller end thereof is defined by Equation (1) above. For a horn section of length L and radii $R_1$ and $R_2$ at opposite ends thereof, Equation (1) can be rewritten as:

$$R^p = R_1^p + \left( \frac{R_2^p - R_1^p}{L^p} \right) l^p \tag{2}$$

where l is the axial distance along the horn measured from the smaller end thereof, and the exponent p has a value greater than two. More specifically, the exponent p has a value sufficiently greater than two, preferably at least 2.5, that the antenna has a $TM_{11}$ mode level substantially below the $TM_{11}$ mode level of the same antenna with a hyperbolic longitudinal shape at the smaller end of the horn. It is preferred that the $TM_{11}$ mode level be at least 5 dB, at 6 GHz, below the $TM_{11}$ mode level of the same antenna with a hyperbolic longitudinal shape.

When the exponent p has a value of two in Equations (1) and (2), the equations define a hyperbola. Longitudinal hyperbolic shapes have been used in waveguides and antenna feed horns in the prior art (e.g., see R. W. Friis et al., "A New Broad-Band Microwave Antenna System," *AIEE Trans.*, Pt. I, Vol. 77, March, 1958, pp. 97–100). The present invention stems from the discovery that the performance of such feed horns can be improved significantly by changing the longitudinal shape of an input section of the feed horn to a shape defined by a generalized form of the equation that defines a hyperbola but with the exponent increased to a value greater than two. More specifically, it has been found that this new shape significantly reduces the $TM_{11}$ mode level in the horn, which in turn reduces the group delay and the amount of "cross talk", while at the same time reducing the return loss and improving the antenna pattern.

Returning to FIGS. 2 and 3, it can be seen that the lowermost section **10*a* of the horn 10 has a curvilinear longitudinal shape, whereas the balance of the horn 10 has a linear longitudinal shape. In the particular embodiment illustrated, the curvilinear horn section 10*a* is fabricated as a separate part and joined to the upper portion of the horn by mating flanges 16 and 17, but it will be understood that the entire metal portion of the horn could be fabricated as a single unitary part if desired. The lower end of the curvilinear section 10*a* preferably has the same inside diameter and shape as the waveguide or waveguide transition to which it is to be joined. The upper end of the section 10*a* terminates with a flare angle $\theta$ identical to that of the adjacent horn section 10*c***.

The longitudinal shape of the curvilinear horn section **10*a*** is defined by Equations (1) and (2) with the exponent p having a value greater than two. The optimum value of the exponent p for any given application can be determined empirically or by numerical simulation. The optimum value for p is not necessarily the value that yields the minimum level of the $TM_{11}$ mode, but can also be a function of the desired return loss and/or the required length of the curvilinear section of the horn as well as the requisite diameters at opposite ends of the curvilinear section and the requisite flare angle $\theta$ at the wide end thereof.

In one working example of this invention, a new input section was made for a standard "SHX10A" horn-reflector antenna manufactured by Andrew Corporation, and having a 15.75° conical horn. The new input section was a 35-inch section for the lower end of the horn and had a longitudinal shape defined by Equations (1) and (2) with a p of 2.69, a diameter of 2.81" at the lower end, and a diameter of 19.9" at the top end. This new input section was designed to be used in place of the standard input section of the same length with a hyperbolic longitudinal shape (p=2).

This new horn input section was tested in a system that included a WS176 four-port combiner cascaded by a WS176-to-WS179 waveguide taper, a WS179-to-WC269 waveguide taper, a 220-foot curved run of WC269 waveguide, a WC269-to-WC281 waveguide taper, and the new horn input section. This system was tested for group delay across the frequency band of 6.425 to 7.125 GHz and found to produce a peak-to-peak group delay of about 2 nanoseconds at the low end of the band and less than 1.5 nanoseconds across the rest of the band. With the standard hyperbolic horn input section in the same system, the peak-to-peak group delay was 2.5 nanoseconds near the mid-band frequency and generally greater than 2.2 nanoseconds in the rest of the band. This reduction in group delay is indicative of a significant reduction in the $TM_{11}$ mode level.

In another test in which the WC269 waveguide was replaced with a 10-foot run of WC281 waveguide, the same horn-reflector antenna input sections were tested in the frequency band from 5.925 to 6.425 GHz. The transmitted signal and the ripple frequency were both measured, and then the following calculations were made:

$$To = \frac{1{,}000}{fR} \text{ ns} \quad (1)$$

where fR=ripple frequency in MHz.

$$r = 10^{\frac{DBP}{20}} - 1 \quad (2)$$

(3) r dB=$-20 \log_{10} r$=mode conversion level in dB where DBP=dB excursion from base line representing the dominant $TE_{11}$ mode.

At the midband frequency, the results were as follows:

| Horn Input Section | DBP, dB | fR, MHz | r | r dB | To, nS |
|---|---|---|---|---|---|
| Hyperbolic | 0.033 | 22 | 0.0038 | −48.4 | 45 |
| Invention | 0.021 | 22 | 0.0024 | −52.3 | 45 |

At the upper end of the frequency band, the results were:

| Horn Input Section | DBP, dB | fR, MHz | r | r dB | To, nS |
|---|---|---|---|---|---|
| Hyperbolic | 0.0833 | 22 | 0.0096 | −40.32 | 45 |
| Invention | 0.033 | 22 | 0.0038 | −48.39 | 45 |

The above data indicates that the conversion level of the "echo" ($TE_{11}$ mode to backward $TM_{11}$) was about −48 to −52 dB down with the new horn input section of the present invention, which was at least 4 to 8 dB better than the standard horn input section.

In addition to the actual data presented above, computed theoretical data indicates that in the commercial "SHX10A" antenna identified above, this invention is capable of reducing the forward (radiated) $TM_{11}$ mode level by an average of 5 dB across the frequency band of 3.7 to 13.0 GHz; reduces the forward $TE_{12}$ mode level by 5.5 dB; reduces the backward $TM_{11}$ mode level by 5 dB at 6 GHz, decreasing monotonically to 2 dB at 13 GHz; and reduces the return loss by an average of 2 dB across the 3.7-to-13.0 GHz band.

Figure 5A:
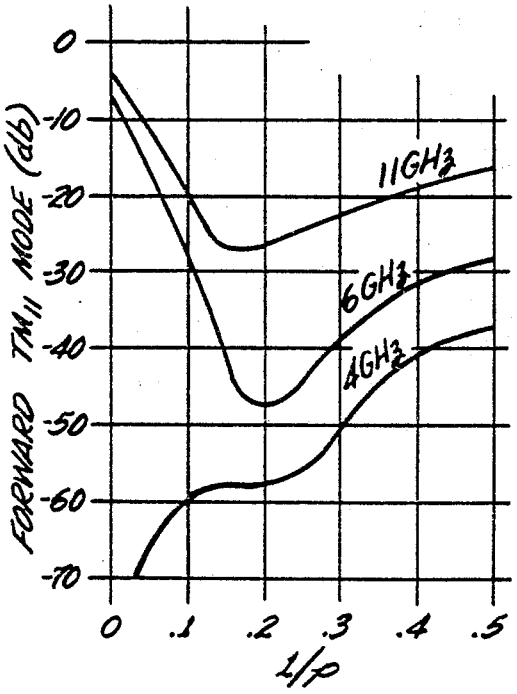
FIGS. 5A and 5B are graphs illustrating the level of the $TM_{11}$ circular waveguide mode as a function of the exponent p at different frequencies and different flare angles $\theta$ in exemplary waveguide sections embodying the invention.
Figure 5B:
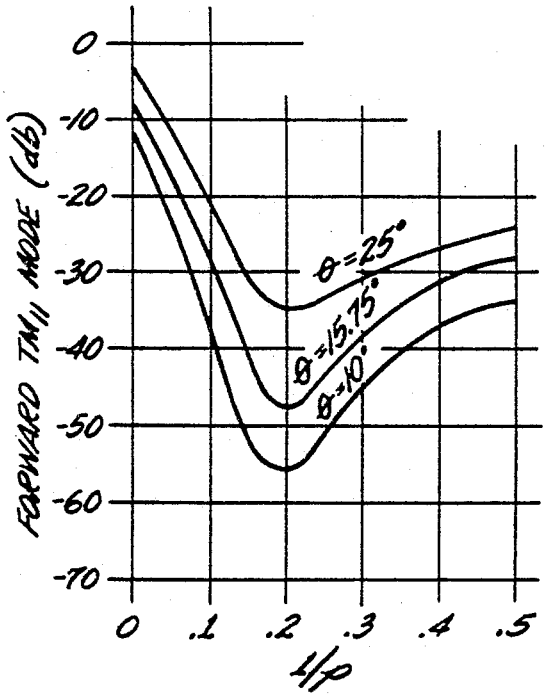

FIGS. 5A and 5B are theoretical (predicted) graphs of the forward $TM_{11}$ mode level as a function of the exponent p (plotted as the reciprocal 1/p in FIGS. 5A and 5B). Certain of the points on the curves in FIGS. 5A and 5B are verified by the actual tests described above, and the values at (1/p=0) were calculated from the equations given in K. Tomiyasu, "Conversion of $TE_{11}$ Made By A Large Diameter Conical Junction", *IEEE Transactions on Microwave Theory and Techniques*, Vol. MTT-17, pp. 277–279, May 1969. The curves in FIG. 5A are plotted at three different frequency values (4, 6 and 11 GHz) for a waveguide section having R1=1.406", R2=9.969" and $\theta$=15.75°. In FIG. 5B, the curves are plotted at three different angles $\theta$ (10°, 15.75° and 25°) for a waveguide section having R1=1.406" and R2=9.969", and a constant frequency of 6 GHz. It can be seen from the curves of FIGS. 5A and 5B that significantly improved results are indicated for multi-band operation when the value of p is within the range from about 2.5 to about 7, with the optimum values falling within the range from about 4 to about 6.7.

Figure 6:
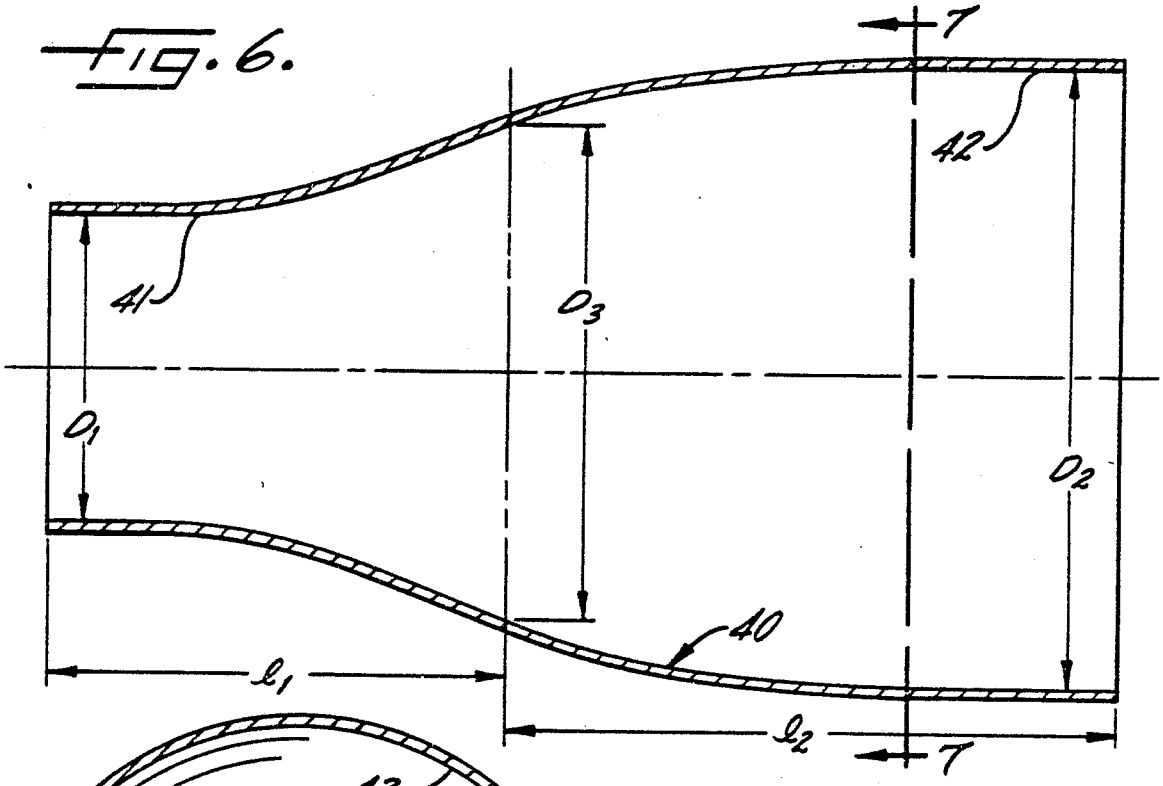
FIG. 6 is a longitudinal section taken diametrically through an overmoded waveguide transition embodying the invention.
Figure 7:
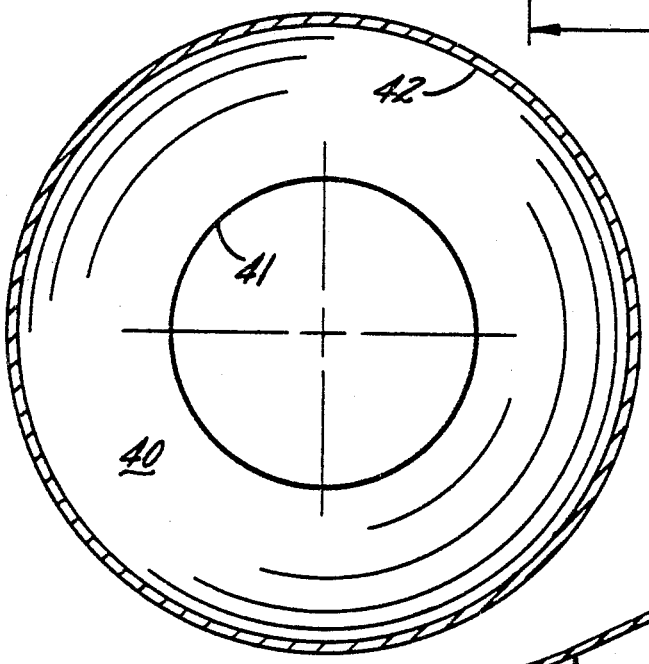
FIG. 7 is a transverse section taken generally along the line 7—7 in FIG. 6.

FIGS. 6 and 7 illustrate the use of the present invention in a waveguide transition whose inside walls 40 taper monotonically from a relatively small circular cross-section having a diameter D1 to a relatively large circular cross-section having a diameter D2. It can be seen that the transition comprises two distinct sections 41 and 42, each of which has a longitudinal shape defined by Equation (1) with the exponent p having a value greater than two. In general the preferred value of p in the illustrative transitions is in the range from about 2.5 to about 3.5. The two sections 41 and 42 are non-uniform horn sections which terminate at opposite ends of the transition with respective diameters D1 and D2 identical to those of the two different waveguides to be joined by the transition 40. These sections 41 and 42 are non-uniform because the radii thereof change at variable rates along the axis of the transition. The two sections 41 and 42 preferably have zero slope at the diameters D1 and D2 where they mate with the respective waveguides to be connected. In most applications one or both of these sections 41 and 42 will be overmoded, i.e., they will support the propagation of unwanted higher order modes of the desired microwave signals being propagated therethrough.

The two sections 41 and 42 preferably merge with each other without any discontinuity in the slope of the internal walls of the transition; that is, the adjoining ends of the two sections 41 and 42 have the same slope where the respective sections join, i.e., at D3.

Figure 8:
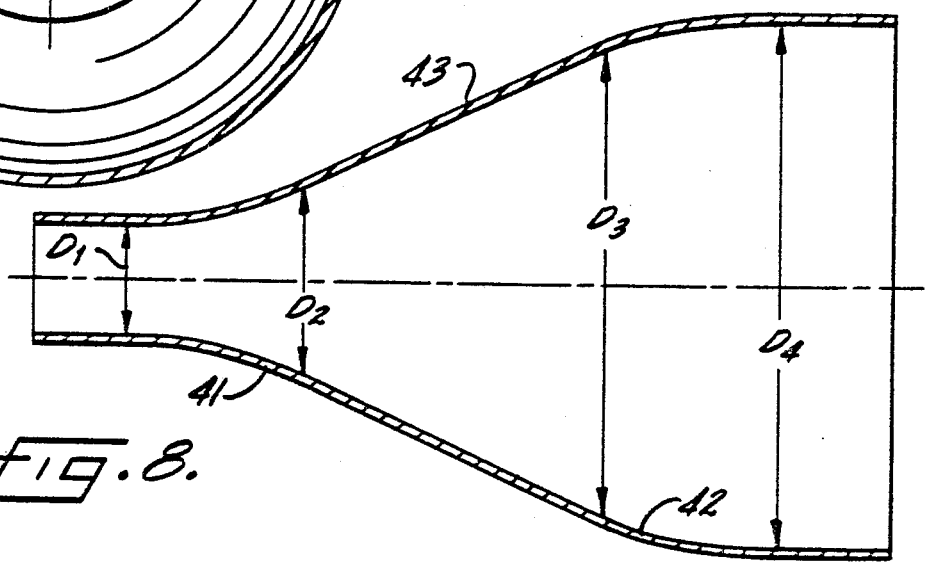
FIG. 8 is a longitudinal section taken diametrically through a modified overmoded waveguide transition embodying the invention.

If desired, a uniform or linearly tapered center section 43 can be interposed between the two non-uniform sections 41 and 42, as illustrated in FIG. 8. The linear section 43 extends from diameter D2 to diameter D3. This type of transition is described in more detail in our copending U.S. patent application Ser. No. 499,318, filed May 31, 1983, now U.S. Pat. No. 4,553,112 for "Phased-Overmoded Waveguide Transition." Because the central section 43 is tapered linearly in the longitudinal direction, this section of the transition results in virtually no unwanted higher order modes such as the $TM_{11}$ mode. More importantly, the linearly tapered central section 43 functions as a phase shifter between the two curvilinear end sections 41 and 42. As described in the aforementioned copending application, this phase-shifting function of the central section 43 is significant because it is a principal factor in the cancellation, within the transition, of higher order modes generated within the curvilinear end sections 41 and 42.

As can be seen from the foregoing detailed description, this invention provides an improved horn-reflector antenna which produces low levels of undesired, higher order modes such as the $TM_{11}$ mode, thereby improving the RPE of the antenna and minimizing group delay and resultant "cross talk", while at the same time reducing the return loss in both the transmit and receive directions. These improved results can be produced over a relatively wide frequency band, e.g., as wide as 20 GHz. The net result is a significant upgrading in the overall performance of the antenna. This invention also provides improved overmoded waveguide transitions which produce low levels of undesired, higher order modes such as the $TM_{11}$ mode, in combination with a low return loss in both directions, over a relatively wide frequency band.

Although the invention has been described above with particular reference to waveguides and feed horns of circular cross-section, the invention is applicable to waveguides and fed horns having different cross-sectional shapes such as square, rectangular, elliptical and the like. In fact, the waveguide section in which this invention is utilized may have different cross-sectional shapes along its length, as in a rectangular-to-circular waveguide transition, for example. When the cross-sectional shape is non-circular, the variable r in equation (1) above becomes the transverse dimension from the longitudinal axis of the waveguide to the side wall whose longitudinal shape is defined by the equation.

We claim as our invention:

1. A horn-reflector antenna comprising
   a paraboloidal reflector for transmitting and receiving microwave energy, and
   a flared feed horn for guiding microwave energy to and from said reflector, the longitudinal shape of at least a section of said horn at the end where the horn begins to flare outwardly being defined by the equation $$R^p = R_1^p + \left( \frac{R_2^p - R_1^p}{L^p} \right) l^p$$

where R is the transverse dimension from the longitudinal axis of the horn to the side wall of the horn, l is the axial distance along the horn measured from said end where the horn begins to flare outwardly, $R_1$ and $R_2$ are the radii of the horn at opposite ends of the horn section defined by said equation, L is the axial length of the horn section defined by said equation, and the exponent p has a value greater than two and less than about 7, to effect a substantial reduction in the $TM_{11}$ mode level.

2. A horn-reflector antenna as set forth in claim 1 wherein said exponent p has a value sufficiently greater than two that said antenna has a $TM_{11}$ mode level substantially below the $TM_{11}$ mode level of the same antenna with a hyperbolic (p=2) longitudinal shape along the length L between the radii $R_1$ and $R_2$.

3. A horn-reflector antenna as set forth in claim 2 wherein said antenna has, at 6 GHz, a $TM_{11}$ mode level at least 5 dB below the $TM_{11}$ mode level of the same antenna with a hyperbolic longitudinal shape.

4. A horn-reflector antenna as set forth in claim 1 wherein the exponent p has a value of at least 2.5.

5. A horn-reflector antenna as set forth in claim 1 wherein the exponent p has a value greater than about 2.5.

6. A horn-reflector antenna as set forth in claim 1 wherein the exponent p has a value within the range from about 4 to about 6.7.

7. A method of reducing the $TM_{11}$ mode level in a horn reflector antenna having a paraboloidal reflector for transmitting and receiving microwave energy, and a smooth-walled, flared feed horn for guiding microwave energy to and from said reflector, said method comprising shaping a section of said horn at the end where the horn begins to flare outwardly so that the inside wall of said section is defined by the equation $$R^p = R_1^p + \left( \frac{R_2^p - R_1^p}{L^p} \right) l^p$$

where R is the transverse dimension from the longitudinal axis of the horn to the side wall of the horn, l is the axial distance along the horn measured from said end where the horn begins to flare outwardly, $R_1$ and $R_2$ are the radii of the horn at opposite ends of the horn section defined by said equation, L is the axial length of the horn section defined by said equation, and the exponent p has a value greater than two and less than about 7, to effect a substantial reduction in the $TM_{11}$ model level.

8. A method as set forth in claim 7 wherein said exponent p has a value sufficiently greater than two that said antenna has a $TM_{11}$ mode level substantially below the $TM_{11}$ mode level of the same antenna with a hyperbolic (p=2) longitudinal shape along the length L between the radii $R_1$ and $R_2$.

9. A method as set forth in claim 8 wherein said antenna has, at 6 GHz, a $TM_{11}$ mode level at least 5 dB below the $TM_{11}$ mode level of the same antenna with a hyperbolic longitudinal shape.

10. A method as set forth in claim 7 wherein the exponent p has a value of at least 2.5.

11. A method as set forth in claim 7 wherein the exponent p has a value greater than about 2.5.

12. A method as set forth in claim 7 wherein the exponent p has a value within the range from about 4 to about 6.7.

* * * * *